US005666618A

United States Patent [19]

Lee et al.

[11] Patent Number: 5,666,618

[45] Date of Patent: Sep. 9, 1997

[54] DEVELOPING DEVICE WITH AGITATION MEMBER AND ELASTIC MEMBER

[75] Inventors: Su-In Lee, Seoul; Young-Taek Lym, Kangnam-gu, both of Rep. of Korea

[73] Assignee: SamSung Electronics Co., Ltd., Suwon, Rep. of Korea

[21] Appl. No.: 672,632

[22] Filed: Jun. 28, 1996

[30] Foreign Application Priority Data

Jun. 30, 1995 [KR] Rep. of Korea ..... 18985/1995

[51] Int. Cl.[6] ..... G03G 15/08

[52] U.S. Cl. ..... 399/254; 399/258

[58] Field of Search ..... 355/254, 255, 355/258, 260, 262, 263; 222/DIG. 1

[56] References Cited

U.S. PATENT DOCUMENTS

| | | | |
|---|---|---|---|
| 4,696,418 | 9/1987 | Kurotaka et al. | 399/262 |
| 5,016,560 | 5/1991 | Asada et al. | 399/281 |
| 5,034,773 | 7/1991 | Nimura et al. | 399/256 |
| 5,095,850 | 3/1992 | Komuro | 399/282 |
| 5,128,722 | 7/1992 | Natsuhara | 399/280 |
| 5,138,385 | 8/1992 | Toyoshi et al. | 399/88 |
| 5,177,539 | 1/1993 | Tsuji | 399/281 |
| 5,289,243 | 2/1994 | Sakamoto | 399/119 |
| 5,307,128 | 4/1994 | Murasaki et al. | 399/255 |

FOREIGN PATENT DOCUMENTS 6-167880 6/1994 Japan .

*Primary Examiner*—Joan H. Pendegrass
*Attorney, Agent, or Firm*—Robert E. Bushnell, Esq.

[57] ABSTRACT

An new and improved developing device for use in an image forming apparatus formed in a unitary structure constructed with a developing chamber disposed adjacent to the rotating electrostatic latent image carrying member, and a toner supply chamber for containing new toner. A developing roller is disposed in the developing chamber, for developing an electrostatic latent image formed on the rotating electrostatic latent image carrying member during operation of the image forming apparatus. An agitating roller is disposed in the developing chamber and adjacent to the developing roller, for charging the new toner as supplied from the toner supply chamber. A toner supply roller is arranged at a toner supply outlet of the toner supply chamber, for supplying the new toner from the toner supply chamber to the developing chamber during operation of the image forming apparatus. An agitation member having a contact wing disposed at its opposite ends, is disposed in the toner supply chamber for rotating and agitating the new toner contained the toner supply chamber to feed the new toner to the toner supply roller at the toner supply outlet of the toner supply chamber. An elastic member of a predetermined size formed by a cylindrical coiled spring is freely disposed in the toner supply chamber, for preventing stagnation of the new toner contained in the toner supply chamber upon rotation of the agitation member. Finally, a rib member is attached to an interior surface of the toner supply chamber, for regulating the movement of the elastic member upon rotation of the agitation member.

20 Claims, 3 Drawing Sheets

DEVELOPING DEVICE WITH AGITATION MEMBER AND ELASTIC MEMBER

CROSS-REFERENCE TO RELATED APPLICATION

This application makes reference to, incorporates the same herein, and claims all benefits accruing under 35 U.S.C. §119 from an application for *Developing Device Of An Image Forming Apparatus Using An Electrophotographic Process* earlier filed in the Korean Industrial Property Office on 30 Jun. 1996, and there duly assigned Ser. No. 18985/1995.

BACKGROUND OF THE INVENTION

1. Technical Field

The present invention relates to a developing device for use in an image forming apparatus using an eletrophotographic process such as a copier, a laser beam printer, a facsimile using plain paper, and more particularly to a developing device of the type having a developing chamber and a toner supply chamber in a unitary structure in which an elastic member is installed in adjacent to an agitating member for stirring toner particles contained in the toner supply chamber, conveying the toner particles to the developing chamber for forming a toner image, and preventing the toner particles from condensation in the toner supply chamber.

2. Background Art

In an image forming apparatus using an eletrophotographic process such as a copier, a laser beam printer, a facsimile using plain paper, a developing device is customarily used for developing an electrostatic image formed on an image carrier such as a photosensitive drum. Conventional developing device typically comes in two types: a mono-component developer such as disclosed in U.S. Pat. No. 5,016,560 for *Device For Image Toner Distribution On A Developing Device* issued to Asada et al., U.S. Pat. No. 5,128,722 for *Developing Device Excellent In Toner Transportability* issued to Natsuhara et at., and U.S. Pat. No. 5,13833,385 for *Developing Device With Electrically Floating Developing Roller* issued to Toyoshi et at., and a two-component developer such as disclosed in U.S. Pat. No. 4,860,063 for *Method Of Controlling Developer Toner Density Of Developing Device* issued to Okamoto, U.S. Pat. No. 5,034,773 for *Developing Unit With A Member For Agitating The Toners In A Developer* issued to Nimura et at., U.S. Pat. No. 5,095,850 for *Developing Device* issued to Komuro, and U.S. Pat. No. 5,177,539 for *Developing Device* issued to Tsuji, and U.S. Pat. No. 5,289,243 for *Installation And Removal Structure Of A Developing Unit And A Toner Cartridge In An Image Forming Apparatus* issued to Sakamoto.

Generally, two-component developers of a unitary structure include non-magnetic toner particles contributing to developing and magnetic carrier particles for properly charging the toner particles. Usually, in such a developing unit, the developer is carried on the outer circumferential surface of a developing roller disposed facing a photosensitive drum, and the toner particles contained in the developer are made to adhere to an electrostatic latent image on the photosensitive drum as the developing roller revolves in order to develop the latent image into a toner image. Since the toner in the developer in the developing unit is gradually consumed as it is used for developing electrostatic latent images, new toner is supplied as needed to the developing unit from a toner supply chamber. In the developing unit, an agitation roller and a mixing roller are disposed beneath the toner supply chamber in order to adequately agitate and mix the supplied toner into the developer accommodated in the developing chamber. A doctor blade is also installed in the developing chamber to regulate the amount of developer carried on the rotating surface of the developing roller.

Mono-component developers of a unitary structure are generally simpler and can be made smaller in size and lower in cost, as compared with the two-component developers. Mono-component developers are typically classified into magnetic and non-magnetic developers. In principle however, a developing roller is set between a photosensitive drum and a toner supply chamber. A toner supply roller which supplies toner to the developing roller and a coating blade are pressed against the developing roller. Rotation of the toner supply roller causes toner particles to be transferred to the developing roller so as to form a thin toner layer on the developing roller. As the developing roller is rotated, a single-component toner adheres to the surface of the developing roller by triboelectronic charges between a coating blade and toner particles, and between the developing roller and the toner particles. Then, the toner particles, supported on the developing roller are caused to adhere electrostatically on a photosensitive drum to form an electrostatic latent image.

In both types of developers, it is important to effectively supply toner contained a toner supply chamber into a developing chamber for developing a toner image. Conventional developing device typically provides an agitation member in a toner supply chamber to agitate the toner particles and feed the toner particles into a toner supply roller located on the side of the photosensitive drum. The agitation member provided in the toner supply chamber comes in many sizes and shapes; but, by at large, it has been our observation that the typical configuration of the agitation member fails to enhance the fluidity of the toner contained in the toner supply chamber. Since the interior of the toner supply chamber is always greater than a turning radius of the agitation member, many toner particles remain stagnated, condensed and unused in the area therebetween. This results in a deterioration of fluidity of the toner, condensation of the toner particles, and consequently a waste of otherwise usable toner particles. Moreover, since most toner supply chambers for use in conventional developers are installed vertically using gravity as a means to gravitate the toner particles to the developing chambers, spatial arrangement of the conventional developers is severely restricted, and as a result, the developers may not be constructed in small sizes.

SUMMARY OF THE INVENTION

Accordingly, it is therefore an object of the present invention to provide an improved developing device for use in an image forming apparatus using an electrophotography process.

It is another object to provide an improved developing device for use in an image forming apparatus in which an unitary structure including a developing chamber and a toner supply chamber remains compact and simplify for installation.

It is yet another object to provide a developing device for use in an image forming apparatus a having a developing chamber and a toner supply chamber in a unitary structure in which an elastic member is installed in adjacent to an agitating member for stirring toner particles contained in the toner supply chamber, conveying the toner particles to the developing chamber for forming a toner image, and preventing the toner particles from condensation in the toner supply chamber in order to enhance the fluidity of the toner.

These and other objects can be achieved by an improved developing device disposed adjacent to a rotating electrostatic latent image carrying member for use in an image forming apparatus using an electrophotographic process. The developing device has a unitary structure constructed with a developing chamber disposed adjacent to the rotating electrostatic latent image carrying member, and a toner supply chamber for containing new toner. A developing roller is disposed in the developing chamber, for developing an electrostatic latent image formed on the rotating electrostatic latent image carrying member during operation of the image forming apparatus. An agitating roller is disposed in the developing chamber and adjacent to the developing roller, for charging the new toner as supplied from the toner supply chamber. A toner supply roller is arranged at a toner supply outlet of the toner supply chamber, for supplying the new toner from the toner supply chamber to the developing chamber during operation of the image forming apparatus. An agitation member having a contact wing disposed at its opposite ends, is disposed in the toner supply chamber for rotating and agitating the new toner contained the toner supply chamber to feed the new toner to the toner supply roller at the toner supply outlet of the toner supply chamber. An elastic member of a predetermined size formed by a cylindrical coiled spring is freely disposed in the toner supply chamber, for preventing stagnation of the new toner contained in the toner supply chamber upon rotation of the agitation member. Finally, a rib member is attached to an interior surface of the toner supply chamber, for regulating the movement of the elastic member upon rotation of the agitation member.

In addition, a doctor blade is projected from a side wall of the developing chamber, for regulating an amount of developer mixed from the new toner supplied from the toner supply chamber and a carrier on the developing roller for developing the electrostatic latent image. Similarly, a developer density sensor is disposed in said developer chamber for sensing a density of developer mixed from the new toner supplied from the toner supply chamber and a carrier for the development of the electrostatic latent image formed on the rotating electrostatic latent image carrying member.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
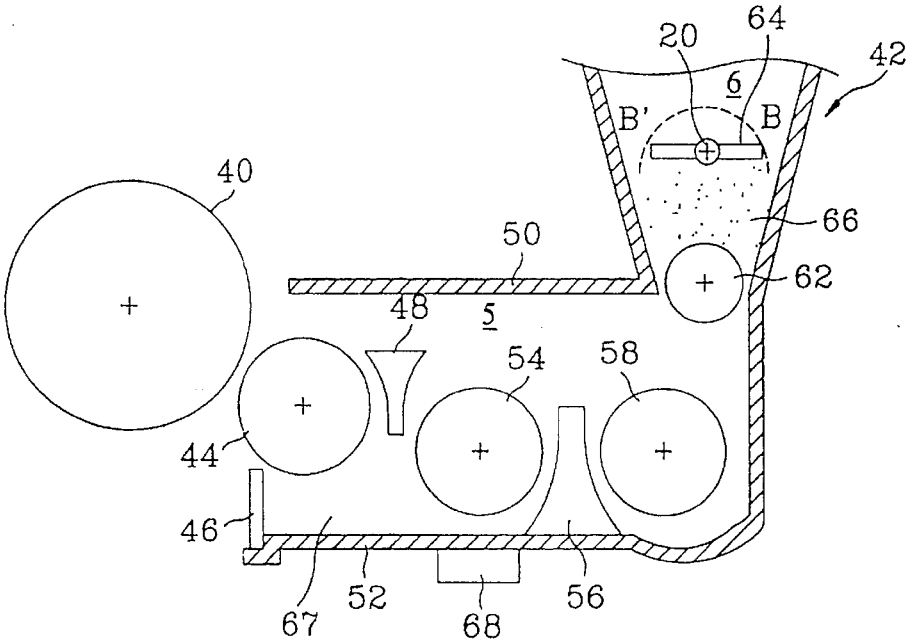
Fig. 1 (PRIOR ART)
FIG. 1 is a schematic view illustrating a typical developing device for use in an image forming apparatus using an electrophotographic process.

Referring now to the drawings and particularly to FIG. 1, which illustrates a typical developing device of an image forming apparatus using an electrophotographic process for a two-component development installed adjacent to a photosensitive drum 40 which is rotatably supported on the side plate of the main body of an image forming apparatus (not shown). As shown in FIG. 1, the developing device 42 has a unitary structure comprised of an upper frame 50 and a lower frame 52 forming a toner supply chamber 6 installed in an upper portion, and a developing chamber 5 installed in a lower portion in adjacent to a photosensitive drum 40 rotating at a constant speed at one portion thereof. A doctor blade 46 is installed at one portion of the lower frame 52 for regulating the height of developer 67 formed on a surface of a developing roller 44. As is well known, the developer 67 used for forming an electrostatic latent image on the developing roller 44 is a mixture of toner 66 and carrier in a predetermined ratio.

In the developing chamber 5 of the developing device 42, a developing roller 44 is installed adjacent to the photosensitive drum 40 for forming an electrostatic latent image on the photosensitive drum 40 from the developer 67. A first agitating roller 54 is installed at one side of the developing roller 44 for charging toner 66 by chafing with the carrier. A developer withdrawer 48 is installed to withdraw residual developer after the developer 67 is formed on the developing roller 44. A second agitating roller 58 is installed beneath the toner supply chamber 6 for uniformly agitating toner 66 provided from a toner supply roller 62. A conveyer 56 is installed between the first and second agitating rollers 54 and 58 for conveying the agitated developer 67 toward first agitating roller 54. A developer density maintaining sensor 68 is attached to a lower surface of the lower frame 52 in the developing chamber 5 for sensing the density of developer 67.

At the upper portion of the developing device 42, a toner supply chamber 6 is vertically installed to contain toner 66 so that the toner particles 66 can be supplied to the developing chamber 5 by way of a toner supply roller 62. An agitation member 64 is installed within the toner supply chamber 6 for agitating the toner 66 contained in the toner supply chamber 6 and preventing the toner 66 from condensation and solidification. A shaft 20 is connected at a central portion of the agitation member 64 for transferring rotational force from an external source to rotate the agitating member 64. A toner supply roller 62 is installed at the central portion of toner chamber 60 between the agitation member 64 and the second agitating roller 58 contained in the developing chamber 5 for supplying the agitated toner 66 toward the second agitating roller 58 for subsequent formation of an electrostatic latent image.

The operation of the typical developing device for use in an image forming apparatus having such a structure will be described as follows. When the toner 66 is supplied to the toner supply chamber 60, the toner 66 is agitated by the agitation member 64 and is transferred to the toner supply roller 62 due to gravity. Here, the toner supply roller 62 provides toner 66 of a predetermined mount to the second agitating roller 58.

The second agitating roller 58 then uniformly agitates toner 66, and the toner 66 is transferred by conveyer 56 toward the first agitating roller 54. The first agitating roller 54 charges toner 66 by chafing the same with the carrier and transfers onto the surface of the developing roller 44. Here, the doctor blade 46 regulates the developer 67 formed on the surface of the developing roller 44 at a uniform height.

When a charged surface of the photosensitive drum 40 is exposed to a light source of an exposing portion (not shown) in such a state, an electrostatic latent image is formed at a portion exposed to light. In a condition that the height of developer 67 formed on the surface of developing roller 44 is regulated, only toner 66 corresponding to the electrostatic latent image formed on photosensitive drum 40 is developed. Then, toner 66 is transferred to a feeding sheet by a transferring portion (not shown) and the sheet is pulled out after being fixed by a fuser (not shown). Here, the residual toner on the surface of photosensitive drum 40 is removed by a cleaner (not shown).

As established above, when a typical developing device is used in an image forming apparatus using an electrophotographic process for a two-component development as shown, for example, in FIG. 1, or alternatively for a mono-component development as described in the background invention, it has been our observation that the typical configuration of the agitation member fails to enhance the fluidity of the toner contained in the toner supply chamber. Since the interior of the toner supply chamber is always greater than a turning radius of the agitation member, many toner particles remain stagnated, condensed and unused in the area therebetween. This results in a deterioration of fluidity of the toner, condensation of the toner particles, and consequently a waste of otherwise usable toner particles. Moreover, since most toner supply chambers for use in conventional developers are installed vertically using gravity as a means to gravitate the toner particles to the developing chambers, spatial arrangement of the conventional developers is severely restricted, and as a result, the developers may not be constructed in small sizes.

Figure 2:
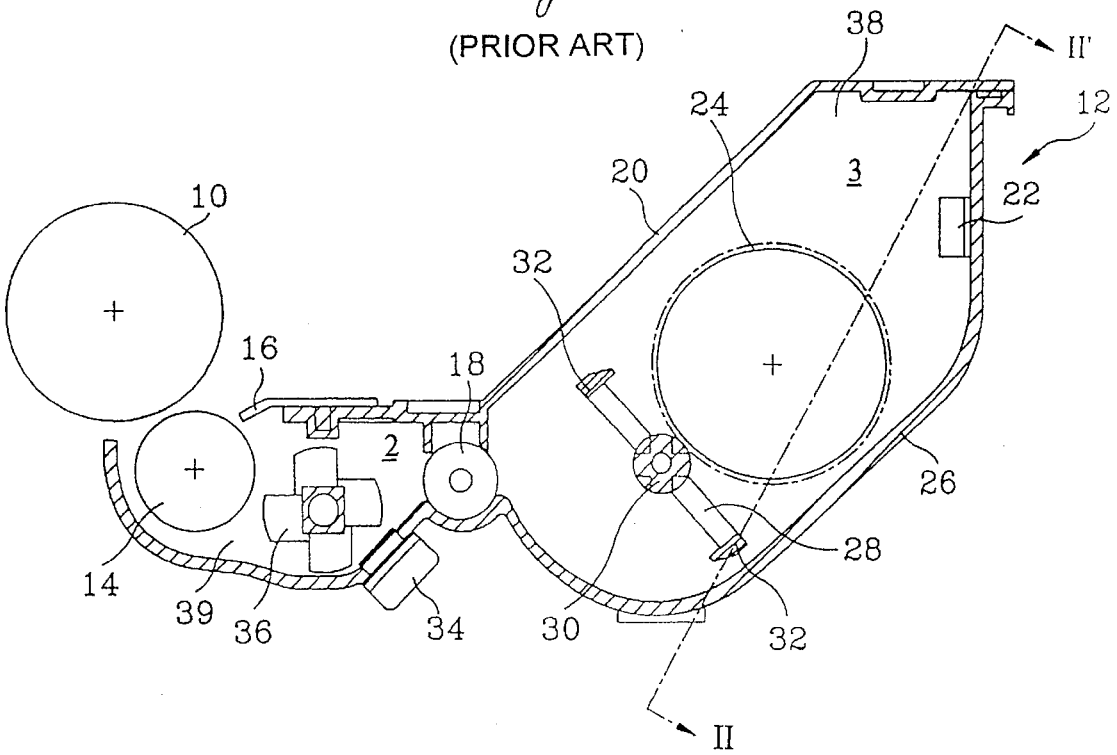
FIG. 2 is a schematic view illustrating a construction of an improved developing device for use in an image forming apparatus using an electrophotographic process according to a preferred embodiment of the present invention.

Turning now to FIG. 2 which illustrates an improved developing device for use in an image forming apparatus using an electrophotographic process constructed according to the principles of the present invention. As shown in FIG. 2, the developing device 12 for use in an image forming apparatus represents one of a two-component developer and a mono-component developer, and has a unitary structure comprised of an upper frame 20 and a lower frame 26 forming a toner supply chamber 3 installed in an upper portion, and a developing chamber 2 installed in a lower portion in adjacent to a photosensitive drum 10 rotating at a constant speed at one portion thereof. A doctor blade 16 is installed at one portion of the upper frame 20 for regulating the height of developer 67 formed on a surface of a developing roller 14. The developer 39 used for forming an electrostatic latent image on the developing roller 14 is a mixture of toner 38 and carrier in a predetermined ratio.

In the developing chamber 5 of the developing device 12, a developing roller 14 is installed adjacent to the photosensitive drum 10 for forming an electrostatic latent image on the photosensitive drum 10 from the developer 39. Developing roller 14 contains a magnetic roller forming a magnetic brush. At one side of the developing roller 14, an agitating roller 36 is installed for fictionally charging toner 38. A developer density maintaining sensor 34 is installed between the lower portion of the agitating roller 36 and the lower frame 26 for sensing the density of developer 39. A toner supply roller 18 is installed at one side of the agitating roller 36 for supplying toner 38 from the toner supply chamber 3 to the agitating roller 36 according to the operation of developer density maintaining sensor 34. An agitation member 28 is installed in the toner supply chamber 3 for agitating and providing toner 38 to the toner supply roller 18, and simultaneously preventing solidification of toner 38 contained in the toner supply chamber 3. At the central portion of the agitation member 28, a shaft 30 is installed to receive an external driving force for rotating the agitation member 28. A contact wing 32 is installed at each opposite end of the agitation member 28 for facilitating the stirring motion of the agitation member 28. An elastic member 24 is formed as a spring for preventing the stagnation of toner 38 at the lower surface inside the toner supply chamber 3. The elastic member 24 is formed with a cylindric coiled spring and having a diameter greater than a turning radius of the agitation member 28. In addition, at the wall side of an upper portion of the lower fame 26, a rib 22 is installed for regulating the position by which the elastic member 24 can form a elastic force.

Figure 3:
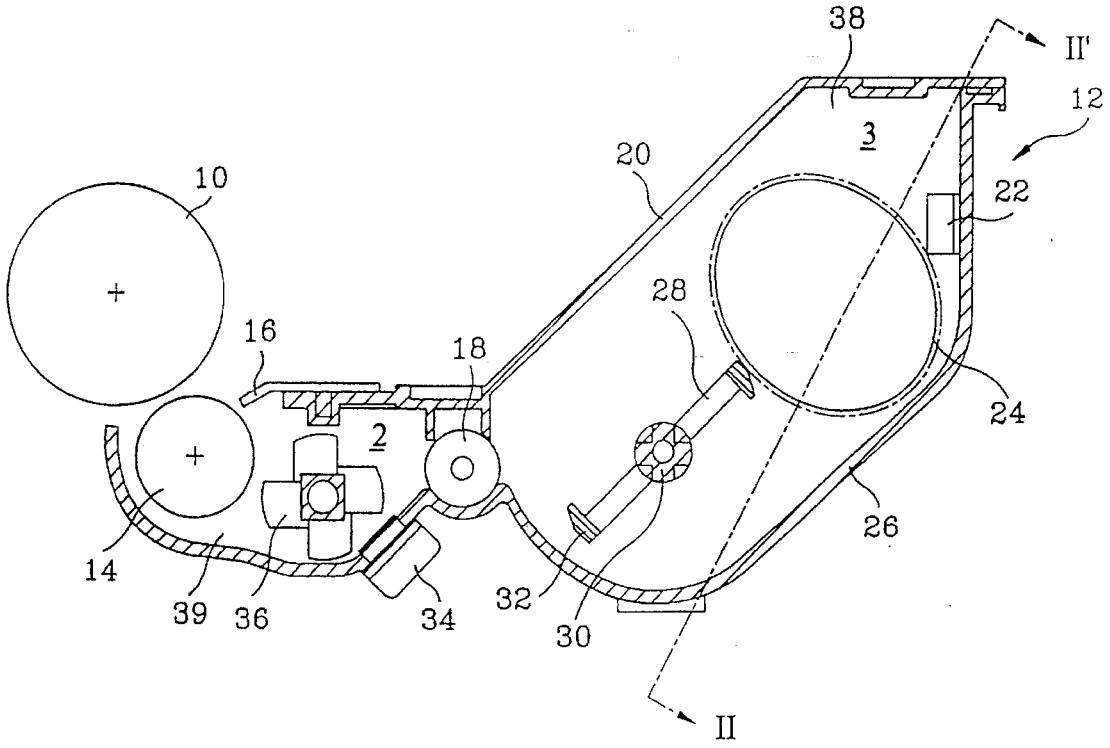
FIG. 3 is a schematic view illustrating an operating state of the developing device for use in an image forming apparatus constructed as shown in FIG. 2.

FIG. 3 illustrates the movement of an elastic member 24 contained in the toner supply chamber 3 as the agitation member 28 rotates during the operation of the image forming apparatus. In essence, when the agitation member 28 rotates, the contact wing 32 disposed on its extended arm pushes the elastic member 24 from an original position resting on the shaft 30 upward until the elastic member 28 is stopped by the rib 22 installed on a lower surface of the toner supply chamber 3. As the contact wing 32 passes through the elastic member 24, the elastic force as created when the elastic member 24 is pressed against the rib 22 allows the elastic member 24 to spring back to its original position sweeping through a dead zone area 11–11' in order to prevent toner particles from remaining stagnated, condensed and unused in the dead zone area 11–11'.

The operation of the developing device having such a structure constructed according to the principles of the present invention will be described as follows. As shown in FIG. 2, toner 38 in the developing device 12 is agitated by the rotation of agitation member 28, where elastic member 24 installed inside developing device 12 is positioned between shaft 30 and lower frame 26 when not in contact with the contact wing 32 formed at opposite ends of the agitation member 28. Meanwhile, when the elastic member 24 contacts the contact wing 32 of the agitation member 28, the elastic member 24 moves upward along the wall in a toner storing area which is a large oval greater than the turning radius of agitation member 28. In doing so, the elastic member 24 is halted by rib 22 at a particular position, and is concurrently rotated due to the friction with rib 22 until compressed by the elastic force of elastic member 24.

Then, when the pressure between the contact wing 32 and elastic member 24 is removed as the agitation member 28 rotates, elastic member 24 produces an impact on toner 38 which has been stagnated in a dead zone 11–11' outside the turning radius of agitator 28 due to the restoring force of elastic member 24. The impacts and vibrations are also generated at the inside surface of lower frame 26 so that toner 38 in the dead zone 11–11' is transported toward the inside of the turning radius of agitation member 28 and then to the toner supply roller 18. When the toner 38 as agitated in the above process is supplied from the toner supply roller 18 to the developing chamber 2, the agitating roller 36 produces a frictional charging between toner 38 and the carrier to form developer 39 on a surface of the developing roller 14. Here, doctor blade 16 uniformly regulates the height of developer 39 formed on the surface of developing roller 14.

When a charged surface of the photosensitive drum 10 is exposed to a light source of an exposing portion (not shown), an electrostatic latent image is formed at a portion exposed to light. When an amount of developer 39 formed on the surface of developing roller 14 is properly regulated, only toner 38 corresponding to the electrostatic latent image formed on photosensitive drum 10 is developed. Then, toner 38 is transferred to a feeding sheet by a transferring portion (not shown) and the sheet is pulled out after being fixed by a fuser (not shown). Here, the residual developer on the surface of photosensitive drum 10 is removed by a cleaner (not shown).

Figure 4:
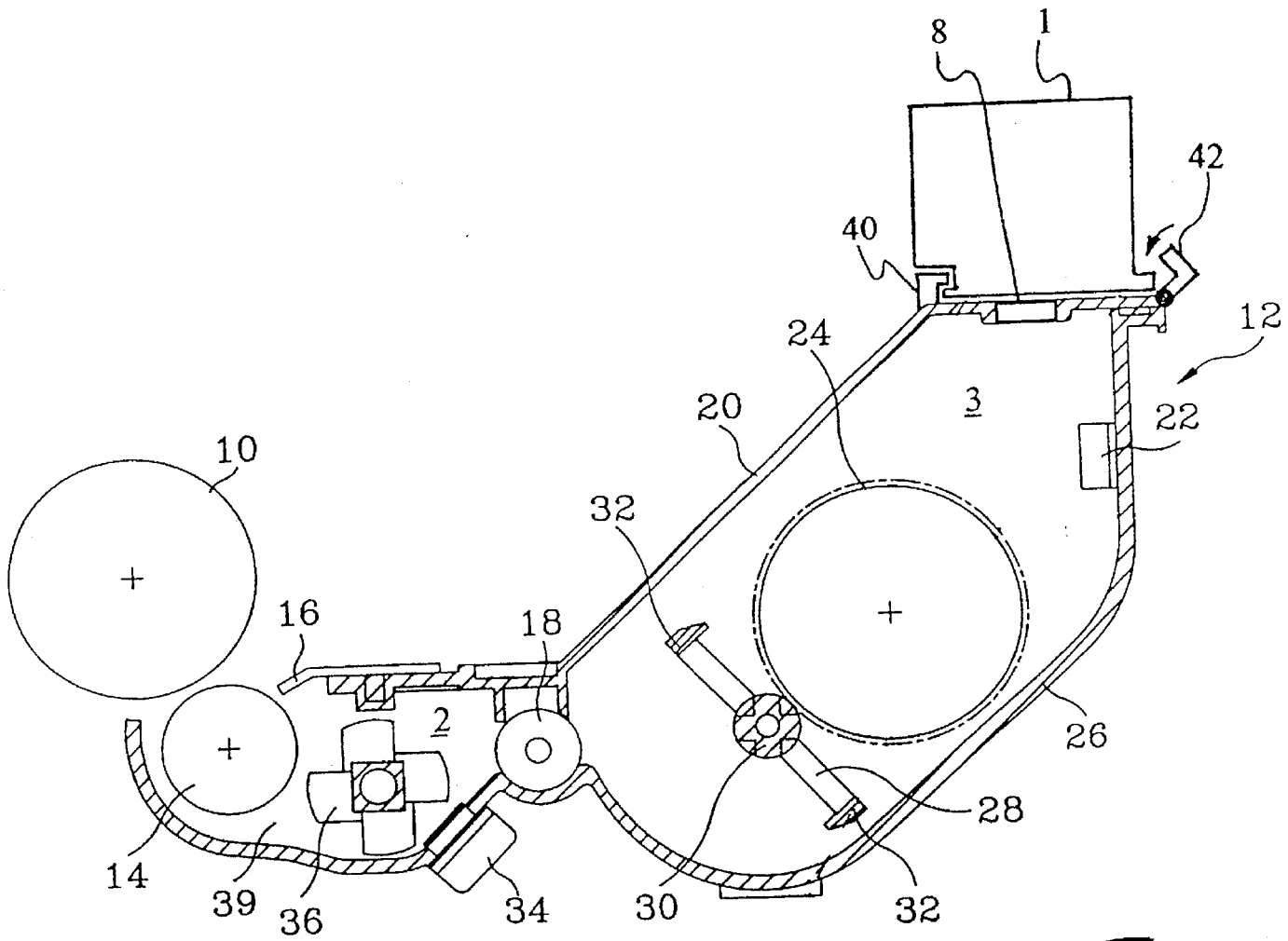
FIG. 4 is a schematic view illustrating a construction of a developing device for use in an image forming apparatus according to a second embodiment of the present invention.

FIG. 4 illustrates a developing device and an additional toner cartridge for use in an image forming apparatus constructed according to a second embodiment of the present invention. The developing device as shown in FIGS. 2 and 3 is further constructed with an opening 8 through which new toner from a renewable toner supply source such as a removable toner cartridge 1 is introduced into the toner supply chamber 3 of the developing device 12. The opening is normally closed but can be opened upon installation of the toner cartridge 1. The toner cartridge 1 is added to the developing device as shown in FIGS. 2 and 3 for extended use, and it can be exchanged while the developing device is installed in the image forming apparatus. The upper frame 24 of the developing device 12 is constructed with a guide rail 40 and a locking mechanism 42. When the toner cartridge 1 is installed on the developing device 12 by sliding its base within the guide rail 40 and the locking mechanism 42 is in a locking position, new toner can be introduced into the toner supply chamber 3 of the developing device 12 without requiring replacement of another developing unit.

As described above, in the developing device for use in an image forming apparatus using an electrophotographic process according to the present invention, a large amount of toner can be stored by forming the inside wall of the lower frame which is greater than the turning radius of the agitator. Also, since the toner is stored using upper and lower frames without requiring an additional toner container, the structure of the developing apparatus is simplified, and in designing the toner storing area, either the vertical or horizontal space can be available. Further, since there is no toner container, the structure of the developing device remains compact, and since the toner always flow smoothly, the residual amount of the toner is reduced, thereby making the developing device more durable.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A developing device disposed adjacent to a rotating electrostatic latent image carrying member in an image forming apparatus, said developing device comprising:

a developing chamber disposed adjacent to a rotating electrostatic latent image carrying member;

a toner supply chamber for containing new toner;

a developing roller disposed in said developing chamber, for developing an electrostatic latent image formed on said rotating electrostatic latent image carrying member during operation of said image forming apparatus;

an agitating roller disposed in said developing chamber and adjacent to said developing roller, for charging said new toner as supplied from said toner supply chamber;

a toner supply roller arranged at a toner supply outlet of said toner supply chamber, for supplying said new toner from said toner supply chamber to said developing chamber during operation of said image forming apparatus;

an agitation member disposed in said toner supply chamber, for rotating and agitating said new toner contained said toner supply chamber to feed said new toner to said toner supply roller at said toner supply outlet of said toner supply chamber;

a contact wing installed at opposite ends of said agitation member;

an elastic member of a predetermined size freely disposed in said toner supply chamber, for preventing stagnation of said new toner contained in said toner supply chamber upon rotation of said agitation member; and a rib member attached in an interior surface of said toner supply chamber, for regulating the movement of said elastic member upon rotation of said agitation member.

2. The developing device of claim 1, further comprised of said elastic member being formed by a cylindrical coiled spring.

3. The developing device of claim 1, further comprised of said developing chamber and said toner supply chamber being fixed to each other to form a unitary structure.

4. The developing device of claim 1, further comprised of said rotating electrostatic latent image carrying member corresponding to a photosensitive drum.

5. The developing device of claim 1, further comprising a doctor blade projecting from a side wall of said developing chamber, for regulating an amount of developer mixed from said new toner supplied fore said toner supply chamber and a carrier on said developing roller for developing said electrostatic latent image.

6. The developing device of claim 5, further comprising a developer density sensor disposed in said developer chamber for sensing a density of developer mixed from said new toner supplied from said toner supply chamber and a carrier for the development of said electrostatic latent image formed on said rotating electrostatic latent image carrying member.

7. The developing device of claim 6, further comprised of said developing roller including a magnetic roller for forming a magnetic brush.

8. The developing device of claim 7, further comprised of said developing chamber and said toner supply chamber being fixed to each other to form a unitary structure, and said unitary structure including an opening on a top surface through which new toner is refurnished into said toner supply chamber.

9. A developing device disposed adjacent to a photosensitive drum in an image forming apparatus, said developing device comprising:

an upper and a lower frame forming a unitary structure containing a developing chamber and a toner supply chamber;

a developing roller disposed in said developing chamber, for developing an electrostatic latent image formed on said photosensitive drum;

a doctor blade projected from a side wail of said developing chamber, for regulating an amount of developer formed on a surface of said developing roller, said developer representing a mixture of toner and a carrier at a predetermined ratio;

an agitating roller disposed in said developing chamber and adjacent to said developing roller, for agitating and mixing said toner as supplied from said toner supply chamber with a carrier to provide said developer;

a developer density sensor disposed in said developer chamber, for sensing a density of developer mixed from said toner supplied from said toner supply chamber and said carrier for the development of said electrostatic latent image formed on said photosensitive drum;

a toner supply roller arranged at a toner supply outlet of said toner supply chamber, for supplying said toner from said toner supply chamber to said developing chamber in accordance with the operation of said developer density sensor;

an agitation member having a contact wing installed at opposite ends, disposed in said toner supply chamber for rotating and agitating said toner contained said toner supply chamber to feed said toner to said toner supply roller at said toner supply outlet of said toner supply chamber;

an elastic member of a predetermined size freely disposed in said toner supply chamber, for preventing stagnation of said toner contained in said toner supply chamber upon rotation of said agitation member; and a rib member attached in an interior surface of said toner supply chamber, for regulating the movement of said elastic member upon rotation of said agitation member.

10. The developing device of claim 9, further comprised of said elastic member being formed by a cylindrical coiled spring.

11. The developing device of claim 10, further comprised of said developing roller including a magnetic roller for forming a magnetic brush.

12. The developing device of claim 11, further comprised of said upper frame including an opening on a top surface through which new toner is refurnished into said toner supply chamber.

13. An image forming apparatus, comprising:

a photosensitive drum; and a developing unit containing a developing chamber and a toner supply chamber, disposed adjacent to said photosensitive drum, said developing unit comprising:

means for developing an electrostatic latent image formed on said photosensitive drum;

means for agitating and mixing said toner as supplied from said toner supply chamber with a carrier for developing said electrostatic latent image on said photosensitive drum;

toner supply means arranged at a toner supply outlet of said toner supply chamber, for supplying said toner from said toner supply chamber to said developing chamber;

an agitation member having a contact wing installed at opposite ends, disposed in said toner supply chamber for rotating and agitating said toner contained said toner supply chamber to feed said toner to said toner supply means at said toner supply outlet of said toner supply chamber;

an elastic member of a predetermined size freely disposed in said toner supply chamber, for preventing stagnation of said toner contained in said toner supply chamber upon rotation of said agitation member; and a rib member attached in an interior surface of said toner supply chamber, for regulating the movement of said elastic member upon rotation of said agitation member.

14. The image forming apparatus of claim 13, further comprised of said elastic member disposed in said toner supply chamber of said developing unit being formed by a cylindrical coiled spring.

15. The image forming apparatus of claim 13, further comprised of said developing unit comprising an opening on a top surface through which new toner is refurnished into said toner supply chamber.

16. The image forming apparatus of claim 13, further comprised of said developing unit comprising a doctor blade projected from a side wall of said developing chamber, for regulating an amount of developer mixed from said toner supplied from said toner supply chamber and said carrier formed on a surface of said developing roller; and a developer density sensor disposed in said developer chamber, for sensing a density of developer for the development of said electrostatic latent image formed on said photosensitive drum.

17. The image forming apparatus of claim 13, further comprised of said developing unit comprising an opening through which new toner is introduced into said toner supply chamber.

18. The image forming device of claim 17, further comprising a toner cartridge mountable on said developing unit to cover said opening for supplying new toner to said toner supply chamber of said developing unit.

19. The image forming device of claim 18, further comprising guide means formed on said developing unit and said toner cartridge for mounting said toner cartridge on said developing unit.

20. The image forming device of claim 19, further comprising a locking mechanism for locking said toner cartridge in position when the toner cartridge is mounted on said developing unit.

* * * * *